US006056035A

United States Patent [19]

Laster-Bivens

[11] Patent Number: 6,056,035

[45] Date of Patent: May 2, 2000

[54] APPARATUS AND METHOD FOR HANGING SHADES AND CURTAINS

[75] Inventor: Linda Laster-Bivens, Powder Springs, Ga.

[73] Assignee: Visison By Two Sisters, Inc., Indian Trail, N.C.

[21] Appl. No.: 09/080,599

[22] Filed: May 18, 1998

[51] Int. Cl.[7] ..... A47H 5/00

[52] U.S. Cl. ..... 160/84.01; 160/178.2; 160/168.1; 160/330; 160/345

[58] Field of Search ..... 160/84.01, 84.04, 160/168.1 R, 173 R, 178.1 R, 178.2, 330, 345, 368.1; 248/263; 211/105.1

[56] References Cited

U.S. PATENT DOCUMENTS

| | | | |
|---|---|---|---|
| 978,220 | 12/1910 | Sarkisian | 160/84.01 |
| 3,439,725 | 4/1969 | Haimovitz et al. | 160/84.01 |
| 4,635,698 | 1/1987 | Anderson | 160/178.2 R |
| 4,667,723 | 5/1987 | Spangenberg | 160/178.2 R |
| 4,877,075 | 10/1989 | Markowitz | 160/84.01 |
| 4,909,297 | 3/1990 | Koller et al. | 160/84 |
| 5,109,908 | 5/1992 | Chen | 160/84.1 |
| 5,109,912 | 5/1992 | Gary | 160/345 |
| 5,273,096 | 12/1993 | Thomsen et al. | 160/84.1 |
| 5,480,040 | 1/1996 | Ryan | 211/105.1 |
| 5,570,490 | 11/1996 | Walsh et al. | 16/87.4 |
| 5,609,197 | 3/1997 | Liao | 160/330 |
| 5,641,143 | 6/1997 | Garza et al. | 248/263 |
| 5,673,741 | 10/1997 | Cairns | 160/330 |
| 5,862,850 | 1/1999 | Yang | 160/84.01 X |

FOREIGN PATENT DOCUMENTS

| | | | |
|---|---|---|---|
| 520955 | 12/1992 | European Pat. Off. | 160/84.01 |
| 15751 | 9/1910 | United Kingdom | 160/178.2 |
| 2086461 | 5/1982 | United Kingdom | 160/178.2 |

*Primary Examiner*—Daniel P. Stodola
*Assistant Examiner*—Bruce A. Lev
*Attorney, Agent, or Firm*—Thomas, Kayden, Horstemeyer & Risley, LLP

[57] ABSTRACT

Apparatus for hanging and removing various styles of shades and curtains such as Roman, Austrian, balloon, or cloud type shades or curtains. The apparatus comprises a hanging bracket, which can either be attached to a wall above a window or within the window box itself, and a hanging grid which, when tilted, can be inserted within the bracket and supported by the bracket's lower flanges. The hanging grid typically takes the form of a coarse metallic screen which comprises a plurality of interwoven heavy gage wires. In use, individual draw cords are threaded through the grid at one of its ends and at discrete predetermined positions along the length of the grid which correlate to string paths provided in the shade or curtain to be hung. Once each individual cord is threaded through the grid at the proper position, it can be passed through the adjacent series of loops provided along the string paths to secure the shade or curtain. To simplify the installation process, the strings can be secured at their ends with quick release cord stops. So described, the system can be used to quickly and easily remove existing shades or curtains and replace them with new and different style shades or curtains without having to use different mounting apparatus or reconfigure the existing mounting apparatus and without the need of tools.

19 Claims, 3 Drawing Sheets

APPARATUS AND METHOD FOR HANGING SHADES AND CURTAINS

FIELD OF THE INVENTION

The invention relates generally to a shade and curtain hanging system. More particularly, the invention relates to a hanging system which includes a hanging grid having a plurality of openings that permit the hanging of various types of shades or curtains without structural modification of the system hardware.

BACKGROUND OF THE INVENTION

The most popular form of shade or curtain is the rod-pocket type. With the rod-pocket configuration, the shade or curtain is provided with an elongated pocket or a plurality of loops along the upper edge of the shade or curtain through which an aluminum or wooden rod is extended. Once the rod is so positioned, it is mounted to a wall or inside a window box with mounting brackets that are already secured to the wall or window box.

One major reason for the popularity of the rod-pocket configuration is simplicity of design. Specifically, these shades or curtains open laterally as opposed to vertically and, therefore, require few draw strings and draw sting connections to the shade or curtain. The structural simplicity permits the user to easily remove the existing shade or curtain to clean it or replace it altogether with another rod-pocket shade or curtain.

Despite simplifying the installation and removal process, rod-pocket shades and curtains are limited in styling. For example, more decorative shade or curtain styles such as Roman, Austrian, balloon, and cloud cannot be used with conventional rod-pocket apparatus since these styles typically require two or more vertically-pulling draw strings that are positioned in predetermined positions along the lateral extent of the shade or curtain. To form Roman, Austrian, balloon, and cloud shades or curtains, the user normally must use a wooden mounting board that is provided with several eye screws secured in positions that correlate with string paths of the shade or curtain. In preparing to hang the shade or curtain, the eye screws must be secured to the mounting board in the correct location and number to match the particulars of the shade or curtain to be hung. Although not exceedingly difficult to install and remove, this apparatus can complicate the changing of the shade or curtain. In particular, when the user wishes to replace an existing shade or curtain with another, the eye screws usually must be removed and repositioned to accommodate the new shade or curtain. Since the mounting board is normally screwed or bolted in place, the changing of the eye screws must be accomplished with the board in place on the wall or the board must first be removed from the wall.

In an effort to alleviate the difficulty in installing and removing different Roman, Austrian, balloon, cloud, and similarly styled shades or curtains, several different hanging devices have been devised. For example, U.S. Pat. No. 4,909,297, issued to Koller et al., discloses a balloon shade hanging apparatus that uses a curtain rod and cord eyelets that are releasably positionable along the length of the rod. Despite permitting the user to hang balloon shades, this design is undesirable for heavier shades and curtains because of the likelihood of the rod bending or breaking the thin wall mounting brackets under the weight of the shade or curtain. Additionally, the complexity of the design increases manufacturing costs and complicates installation.

In U.S. Pat. No. 5,109,908, Chen describes a curtain assembly device that uses a plurality of roller brackets positionable along the length of a support member. Although providing for vertical drawing of the curtain, the Chen design likewise employs intricate parts and is complex in configuration and operation.

From the above, it can be appreciated that it would be desirable to have apparatus that is simple in construction and operation which provides vertical drawing of decorative shades and curtains, and easy changing of styles of the shades or curtains.

SUMMARY OF THE INVENTION

The present invention relates to a shade and curtain hanging system that greatly simplifies the installation and removal of decorative shades and curtains. The hanging system generally comprises an elongated hanging bracket and an elongated hanging grid. The hanging bracket typically includes a top wall, opposed side walls which extend downwardly from the top wall, and opposed lower flanges that extend horizontally inward from the side walls. With this configuration, the bracket is substantially U-shaped in cross-section and forms a hollow inner space that is partially enclosed by the lower flanges. Together, the flanges form an opening through which the hollow inner space may be accessed. Usually, the bracket is composed of a rigid material such as metal, polymeric material, wood, or the like.

The elongated hanging grid is typically substantially thin and rectangular in shape. Normally, the grid is approximately the same length as the elongated hanging bracket and is sized and shaped to fit within the hollow inner space of the elongated hanging bracket. The grid has a plurality of openings that are sized and shaped to permit the passage of individual draw strings therethrough. Normally, the grid comprises a coarse screen composed of interwoven lengths of heavy gauge wire.

In use, a plurality of draw strings are threaded through the openings at one end of the hanging grid and again threaded through the hanging grid at discrete predetermined positions along the length of the hanging grid. These positions correspond in location and number to the location and number of string paths provided on the shade or curtain to be hung. Once the draw strings have been correctly threaded through the hanging grid, the shade or curtain is threaded onto the draw strings. Typically, the string paths of the shade or curtain are formed by narrow tape strips attached to the rear side of the shade or curtain having spaced attachment rings through which the strings are threaded. After the draw strings have been threaded along the string paths, each individual string is secured at its end with a quick release cord stop. Normally, each string is first folded over to form a loop that accommodates a dowel rod which provides weight and form to the shade or curtain.

Once the shade or curtain has been secured to the draw strings, the grid is inserted into the hanging bracket. Before being so inserted, however, the hanging bracket is first installed at the installation site, typically inside a window box or on a wall above the window box. Insertion is accomplished by tilting the hanging grid so that it passes into the hollow inner space of the bracket, and then setting the grid on top of the flanges such that the grid extends across the bracket opening. Finally, the top edge of the shade or curtain can be releasably affixed to the front surface of the hanging bracket with hook and loop fastening material or other conventional fasteners to complete installation of the shade or curtain.

The objects, features, and advantages of this invention will become apparent upon reading the following specification, when taken in conjunction with the accompanying drawings.

DETAILED DESCRIPTION

Figure 1:
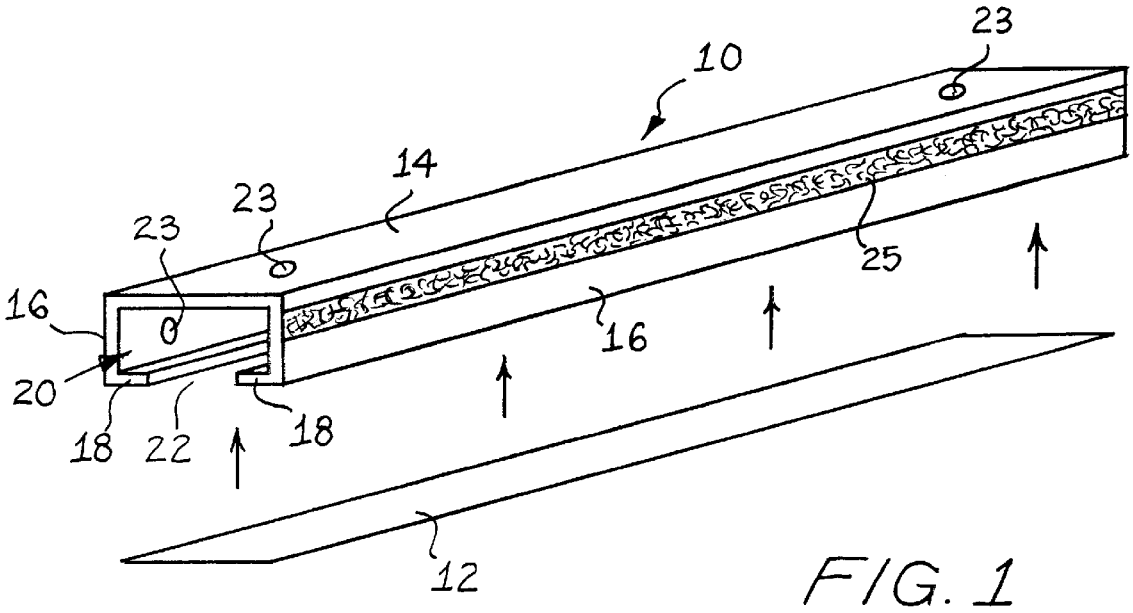
FIG. 1 is a perspective view of the hanging bracket and hanging grid of the present invention.
Figure 2:
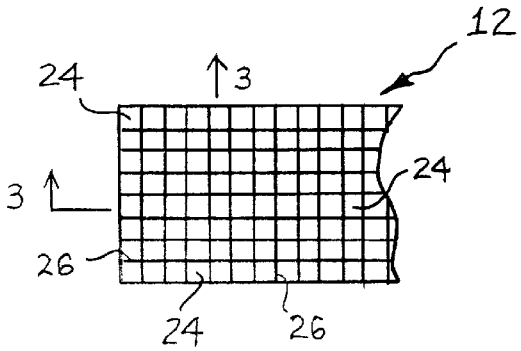
FIG. 2 is a partial top view of the hanging grid shown in FIG. 1.
Figure 3:
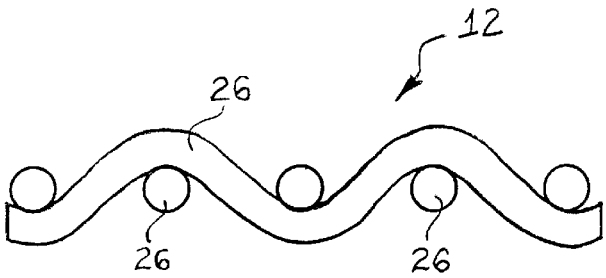
FIG. 3 is a partial cross-sectional view of the hanging grid of FIG. 1.

Referring now in more detail to the drawings, in which like numerals indicate like parts throughout the several views, FIGS. 1–5 illustrate the structure and usage of a shade and curtain hanging system constructed in accordance with the present invention. As shown in FIG. 1, the hanging system generally comprises an elongated hanging bracket 10 and an elongated hanging grid 12. The elongated hanging bracket includes a top wall 14, opposed side walls 16, and opposed lower flanges 18. The side walls extend downwardly in a generally parallel configuration to each other from the top wall such that the bracket is substantially U-shaped in cross-section and forms a hollow inner space 20. The opposed lower flanges extend horizontally inward from the side walls 16 forming an opening 22 therebetween and partially enclosing the hollow inner space 20.

Typically provided in the top wall 14 and one of the opposed side walls 16 are mounting holes 23 which provide alternative mounting options for the installer. In addition, hook and loop fastening material 25 is provided across one of the side walls. This material is adapted to mate with similar hook and loop fastening material which is provided on the shade or curtain to be hung. It is to be noted, however, that while hook and loop fastening material is preferred, other conventional fasteners can be used in lieu of the hook and loop material. Usually, the bracket is composed of a rigid material such as metal, polymeric material, wood, or the like. When metal is used, preferred is a strong, lightweight metal such as aluminum.

As illustrated in FIG. 1, the elongated hanging grid 12 is normally substantially thin and rectangular in shape. Typically, the grid is approximately the same length as the elongated hanging bracket 10 and, as will be discussed in more detail below, is sized and shaped to fit within the hollow inner space 20 formed in the elongated hanging bracket 10. Depicted in FIG. 2, the grid 12 has a plurality of apertures or openings 24. These openings are sized and shaped to permit the passage of individual draw strings therethrough. Normally, the grid 12 and the openings provided therein are formed by interwoven lengths of heavy gauge wire or rod material 26. Accordingly, as shown in cross-section in FIG. 3, the grid typically takes the form of a coarse metallic screen or mesh Although preferably formed as a coarse metallic screen, it will be understood that the grid could be formed of other materials and in other configurations as long as a plurality of openings are provided therein and the grid is of adequate rigidity to support the shade or curtain.

Figure 4:
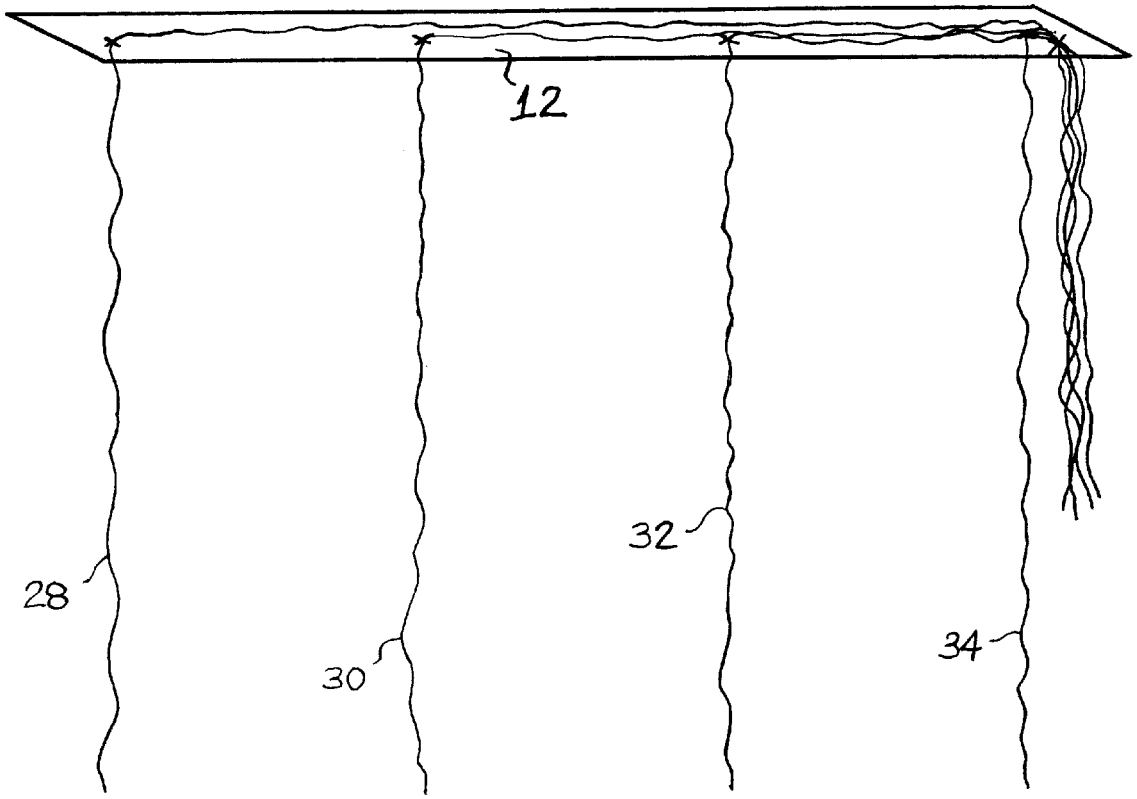
FIG. 4 is a schematic perspective view of the hanging grid with draw strings threaded therein.

FIG. 4 illustrates example preparation of the hanging grid 12 for installation of a shade or curtain. As shown in this figure, a plurality of draw strings 28, 30, 32, and 34 are threaded through openings (depicted with an "x") at one end of the hanging grid. Each individual string is again threaded through the hanging grid at discrete predetermined positions along the length of the hanging grid (each indicated with an "x"). The location of these positions, as well as the number of draw strings used, is dictated by the particulars of the shade or curtain to be hung. For instance, in FIG. 5, four separate string paths 36 are provided in the shade 38 and, accordingly, four separate draw strings are threaded through the hanging grid.

Figure 5:
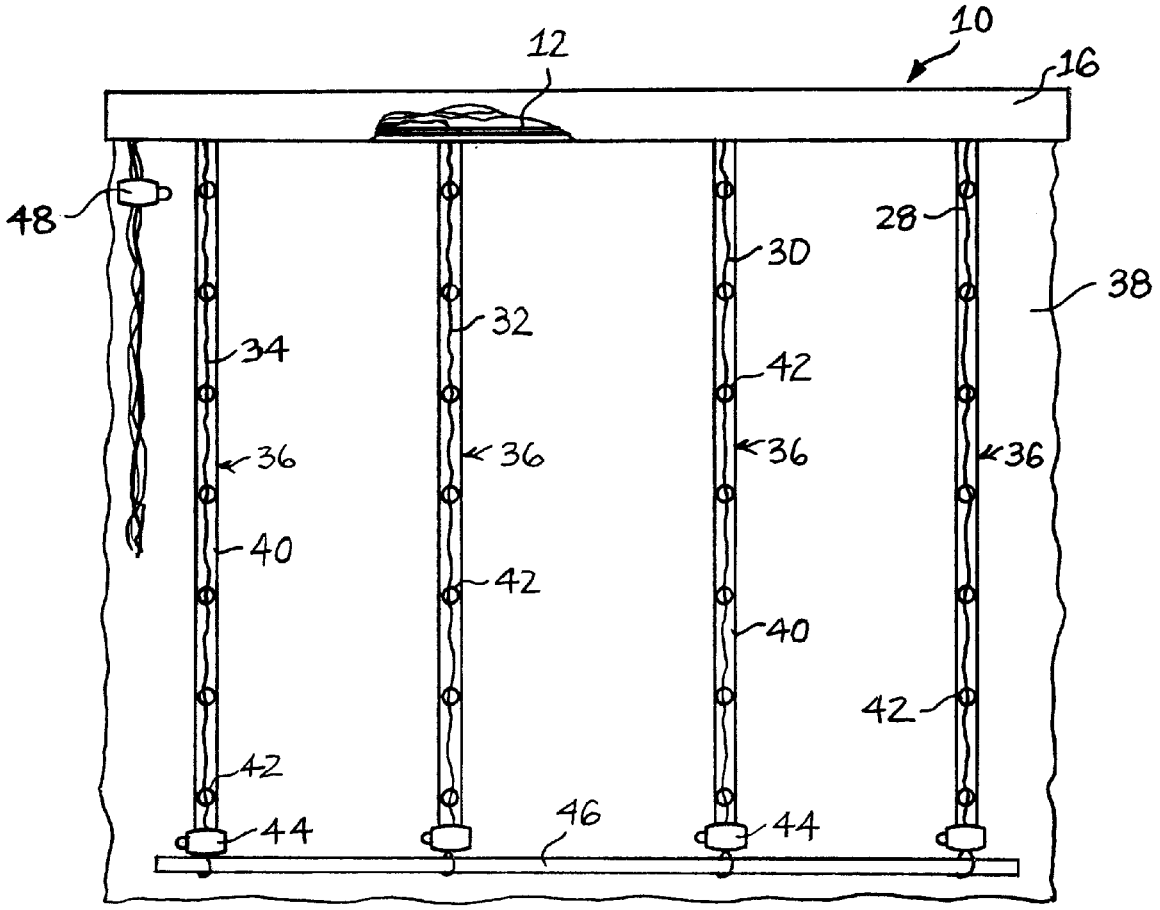
FIG. 5 is a partial cut-away rear view of the hanging system of the present invention shown with a shade or curtain installed thereon.

Once the draw strings 28, 30, 32, and 34 have been correctly threaded through the hanging grid 12, the shade or curtain 38 can then be threaded onto the draw strings. As indicated in FIG. 5, the shade or curtain 38 typically will have a plurality of string paths 36 formed by narrow tape strips 40 having spaced attachment rings 42. Normally, these rings are spaced approximately every 6 to 8 inches along the length of the tape strips. After the draw strings have been threaded along the string paths, each individual string is secured at its end with a quick release cord stop 44. Normally, each string is first folded over to form a loop before the cord stop is applied so that a dowel rod 46 can be threaded through the loops at the end of the draw strings. As is known in the art, the addition of a dowel rod provides weight and form to the shade or curtain to improve its appearance and hanging attributes. Normally, the bundled draw strings at the end of the hanging grid are secured together with a quick release cord stop 48 to ensure even pulling of the shade or curtain with the strings and to improve appearance. As is further known in the art, these strings can be secured to, for example, a conventional wall cleat, if desired.

After the shade or curtain 38 has been secured with the draw strings 28, 30, 32, and 34, the grid 12 can be inserted into the hanging bracket 10 as indicated by the directional arrows of FIG. 1. Normally, however, the hanging bracket 10 is first installed at the installation site by fastening the hanging bracket inside a window box or to the wall above the window box. In that the hanging grid is sized and shaped to fit within the hanging bracket and rest upon the opposed lower flanges 18 of the bracket (FIG. 5), the hanging grid must be tilted downwardly or upwardly with respect to the user such that the grid can pass through the bracket opening 22 and into the hollow inner space 20 and then rest atop the flanges 18. When so positioned, the grid will extend across the opening from one flange to the other. Once the grid is placed on top of the flanges, the top edge of the shade or curtain is releasably affixed to the front surface of the hanging bracket 10 with the hook and loop fastening material or other fasteners to complete installation of the shade or curtain.

So described, the shade and curtain hanging system of the present invention greatly simplifies the shade or curtain installation and removal process. In a matter of minutes, the grid and shade or curtain can be threaded and the grid inserted into the hanging bracket without the need of tools. Since the hanging grid is separate from the hanging bracket, threading the draw strings can be easily accomplished at a work space remote from the installation site. Moreover, in that there are a multiplicity of openings provided in the grid, a nearly infinite number of string configurations is possible. The system user can, therefore, quickly and easily switch from one shade or curtain style to a totally different shade or curtain style without having to use a different mounting bracket or having to structurally reconfigure the mounting bracket.

While preferred embodiments of the invention have been disclosed in detail in the foregoing description and drawings, it will be understood by those skilled in the art that variations and modifications thereof can be made without departing from the spirit and scope of the invention as set forth in the following claims. For example, although the system has been described in relation to particular styles of shades and curtains, it is to be appreciated that the system of the present invention can be used with nearly any type of vertically drawn shade or curtain. In addition, although particular types of cord stops are described and illustrated, it will be understood that different cord stops, or even none at all, could be used as desired.

What is claimed is:

1. A window treatment hanging system, comprising:

an elongated hanging bracket for attaching to a window box or wall, said hanging bracket having a hollow inner space;

an elongated hanging grid comprising a coarse screen, said hanging grid having a plurality of openings provided therein and being sized and shaped to removably fit within said hollow inner space of said hanging bracket such that said grid can be supported by said hanging bracket, said openings being sized and shaped to permit the passage of individual draw strings therethrough; and a plurality of draw strings being sized and shaped to thread through said openings provided in said elongated hanging grid such that said draw strings can be threaded through one end of said grid and individually threaded again through said grid at predetermined points along the length of said elongated hanging grid to correctly align with the shade or curtain to be hung.

2. The window treatment hanging system of claim 1, wherein said elongated hanging bracket is substantially U-shaped in cross-section.

3. The window treatment hanging system of claim 1, wherein said elongated hanging bracket includes opposed lower flanges that define an opening therebetween, said lower flanges capable of supporting said hanging grid such that said hanging grid extends across said opening when said grid is placed within said hollow inner space of said hanging grid and atop said lower flanges.

4. The window treatment hanging system of claim 1, further comprising a plurality of quick release cord stops that are releasably securable to said draw strings.

5. The window treatment hanging system of claim 1, wherein said elongated hanging bracket is provided with hook and loop fastening material for attaching a top edge of the shade or curtain to said mounting bracket.

6. The window treatment hanging system of claim 1, further including a dowel rod that is adapted to secure to the shade or curtain with said draw strings to provide weight and form to the shade or curtain.

7. The window treatment hanging system of claim 1, wherein said elongated hanging grid is made of a metallic material.

8. A window treatment hanging apparatus, comprising:

an elongated hanging bracket for attaching to a window box or wall, said hanging bracket having top wall, opposed side walls extending from said top wall, and opposed lower flanges extending inwardly from said side walls, said top wall and said side walls forming a hollow inner space within said hanging bracket and said lower flanges forming an opening therebetween; and an elongated hanging grid comprising a coarse screen, said hanging grid having a plurality of openings provided therein and being sized and shaped to removably fit within said hollow inner space of said hanging bracket and rest upon said opposed lower flanges such that said grid is supported by said hanging bracket and extends across said opening, said hanging grid openings being sized and shaped to permit the passage of individual draw strings therethrough.

9. The window treatment hanging apparatus of claim 8, wherein said elongated hanging bracket is substantially U-shaped in cross-section.

10. The window treatment hanging apparatus of claim 8, wherein said elongated hanging bracket is provided with hook and loop fastening material for attaching a top edge of a window treatment to said mounting bracket.

11. The window treatment hanging apparatus of claim 8, wherein said elongated hanging grid is made of a metallic material.

12. A window treatment hanging system, comprising:

an elongated and substantially U-shaped hanging bracket for attaching to a window box or wall, said hanging bracket having a top wall, opposed side walls extending from said top wall, and opposed lower flanges extending inwardly from said side walls, said top wall and said side walls forming a hollow inner space within said hanging bracket and said lower flanges forming an opening therebetween;

an elongated hanging grid comprising a coarse screen, said hanging grid having a plurality of openings provided therein and being sized and shaped to removably fit within said hollow inner space of said hanging bracket and rest upon said opposed lower flanges such that said grid is supported by said hanging bracket and extends across said opening, said openings being sized and shaped to permit the passage of individual draw strings threrethrough;

a plurality of draw strings being sized and shaped to thread through said openings provided in said elongated hanging grid such that said draw strings can be threaded through one end of said grid and individually threaded again through said grid at predetermined points along the length of said elongated hanging grid to correctly align with the window treatment to be hung; and a plurality of quick release cord stops that are releasably securable to said draw strings.

13. The window treatment hanging system of claim 12, wherein said elongated hanging bracket is provided with hook and loop fastening material for attaching a top edge of the window treatment to said mounting bracket.

14. The window treatment hanging system of claim 12, further comprising a dowel rod for securing to the window treatment with said draw strings to provide weight and form to the window treatment.

15. The window treatment hanging system of claim 12, wherein said elongated hanging grid is made of a metallic material.

16. A method for hanging a window treatment, said method comprising the steps of:

attaching an elongated hanging bracket having a hollow inner space and opposed lower flanges to an installation site;

threading a plurality of draw strings through one end of an elongated hanging grid comprising a coarse screen and each string again through the grid at predetermined points along the length of the grid that correctly align with the window treatment to be hung;

threading the draw strings along string paths provided on the window treatment;

securing the ends of the draw strings to prevent removal of the strings from the window treatment;

inserting the elongating hanging grid into the hollow inner space of the hanging bracket and resting the hanging grid on the opposed lower flanges; and attaching the top edge of the window treatment to the elongated mounting bracket.

17. The method of claim 16, wherein the step of securing the ends of the draw strings is accomplished with quick release cord stops.

18. The method of claim 16, further including the step of securing a dowel rod to the ends of the draw strings to provide weight and form to the lower edge of the window treatment.

19. The method of claim 16, wherein the elongated hanging grid is made of a metallic material.

* * * * *